US010003872B2

(12) United States Patent
Pellikka et al.

(10) Patent No.: US 10,003,872 B2
(45) Date of Patent: Jun. 19, 2018

(54) SPEAKER ARRANGEMENT

(71) Applicant: Microsoft Technology Licensing, LLC, Redmond, WA (US)

(72) Inventors: Matti Pellikka, Lempäälä (FI); Pasi Kemppinen, Tampere (FI); Klaus Melakari, Oulu (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days. days.

(21) Appl. No.: 15/287,727

(22) Filed: Oct. 6, 2016

(65) Prior Publication Data

US 2018/0103306 A1 Apr. 12, 2018

(51) Int. Cl.
*H04R 1/02* (2006.01)
*H04R 3/14* (2006.01)

(52) U.S. Cl.
CPC ..... *H04R 1/026* (2013.01); *H04R 3/14* (2013.01); *H04R 2400/01* (2013.01); *H04R 2400/11* (2013.01); *H04R 2499/15* (2013.01)

(58) Field of Classification Search
CPC ..... H04R 1/026; H04R 3/14; H04R 2400/01; H04R 2400/11; H04R 2499/15; G06F 3/016; H01H 2215/00–2215/054; H01H 2003/008
USPC ..... 381/332, 333, 334; 340/401.1
See application file for complete search history.

(56) References Cited

U.S. PATENT DOCUMENTS 5,196,755 A 3/1993 Shields
6,332,029 B1 * 12/2001 Azima ..... B42D 15/022 181/166
8,543,168 B2 9/2013 Zurek et al.
8,816,977 B2 8/2014 Rothkopf et al.
8,953,823 B2 2/2015 Fujise et al.
2008/0060856 A1 3/2008 Shahoian et al.
2011/0128245 A1 * 6/2011 Andoh ..... H01L 41/193 345/173
2011/0261021 A1 10/2011 Modarres et al.
2012/0243719 A1 * 9/2012 Franklin ..... G06F 1/1652 381/333
2013/0321299 A1 12/2013 Kim et al.
2014/0055394 A1 2/2014 Park et al.
2014/0145836 A1 5/2014 Tossavainen et al.
2014/0333181 A1 11/2014 Wang et al.
2015/0054779 A1 2/2015 Horii et al.
2015/0063595 A1 3/2015 Kemppinen et al.
(Continued)

FOREIGN PATENT DOCUMENTS

KR 20120014538 A 2/2012
WO 2015199140 A1 12/2015

OTHER PUBLICATIONS

Matysek, et al., "Tactile display with dielectric multilayer elastomer actuatorsq", In Proceedings of SPIE, Electroactive Polymer Actuators and Devices, vol. 7287, Apr. 6, 2009, 2 pages.
(Continued)

*Primary Examiner* — William A Jerez Lora

(57) ABSTRACT

According to one aspect, there is provided an apparatus comprising a frame and a speaker rigidly attached to the frame, where the speaker comprises a display module and at least one vibrating deformable plate element attached to a bottom surface of the display module and configured to at least partially bend, when actuated, the display module to generate at least one of sound waves or tactile feedback.

20 Claims, 3 Drawing Sheets

(56) References Cited

U.S. PATENT DOCUMENTS

| | | | | |
|---|---|---|---|---|
| 2015/0154885 | A1 | 6/2015 | Livermore-clifford et al. | |
| 2015/0195630 | A1* | 7/2015 | Yliaho ..... | H04M 1/0266 381/162 |
| 2015/0373441 | A1 | 12/2015 | Behles et al. | |
| 2016/0004311 | A1 | 1/2016 | Yliaho | |
| 2017/0105294 | A1 | 4/2017 | Shimoda et al. | |
| 2017/0277262 | A1* | 9/2017 | Birnbaum ..... | G06F 3/016 |

OTHER PUBLICATIONS

Sun, et al., "Design optimization of piezoelectric actuator patterns for static shape control of smart plates", In Journal of Smart Materials and Structures, vol. 14, No. 6, Oct. 17, 2005, 2 pages.

"International Search Report and Written Opinion Issued in PCT Application No. PCT/US2017/054203", dated Jan. 26, 2018, 19 pages.

* cited by examiner

SPEAKER ARRANGEMENT

BACKGROUND

An electronic device usually includes a speaker or speakers to enable audio output to a user of the electronic device. Depending on the device, the space needed by the speaker may be significant. On other hand, a mobile electronic device, for example, a smart phone sets certain restrictions to the structure and especially to the overall size and thickness of the speaker. Further, audio quality provided by the speaker needs to be sufficient depending on the electronic device in question.

SUMMARY

This Summary is provided to introduce a selection of concepts in a simplified form that are further described below in the Detailed Description. This summary is not intended to identify key features or essential features of the claimed subject matter, nor is it intended to be used to limit the scope of the claimed subject matter.

In one embodiment, an apparatus is provided. The apparatus comprises a frame and a speaker rigidly attached to the frame, where the speaker comprises a display module and at least one vibrating deformable plate element attached to a bottom surface of the display module and configured to at least partially bend, when actuated, the display module to generate at least one of sound waves or tactile feedback.

In another embodiment, an apparatus is provided. The apparatus comprises an audio signal generator, control circuitry, a frame and a speaker rigidly attached to the frame, where the speaker comprises a display module and at least one vibrating deformable plate element attached to a bottom surface of the display module. The control circuitry is configured to cause the audio signal generator to generate an output to cause the at least one vibrating deformable plate element to at least partially bend the display module to generate at least one of sound waves or tactile feedback.

In another embodiment, a mobile electronic apparatus is provided. The mobile electronic apparatus comprises an audio signal generator, control circuitry, a frame and a speaker rigidly attached to the frame. The speaker comprises a display module and at least one vibrating deformable plate element attached to a bottom surface of the display module, wherein the control circuitry is configured to cause the audio signal generator to generate an output to cause the at least one vibrating deformable plate element to at least partially bend the display module to generate at least one of sound waves or tactile feedback.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
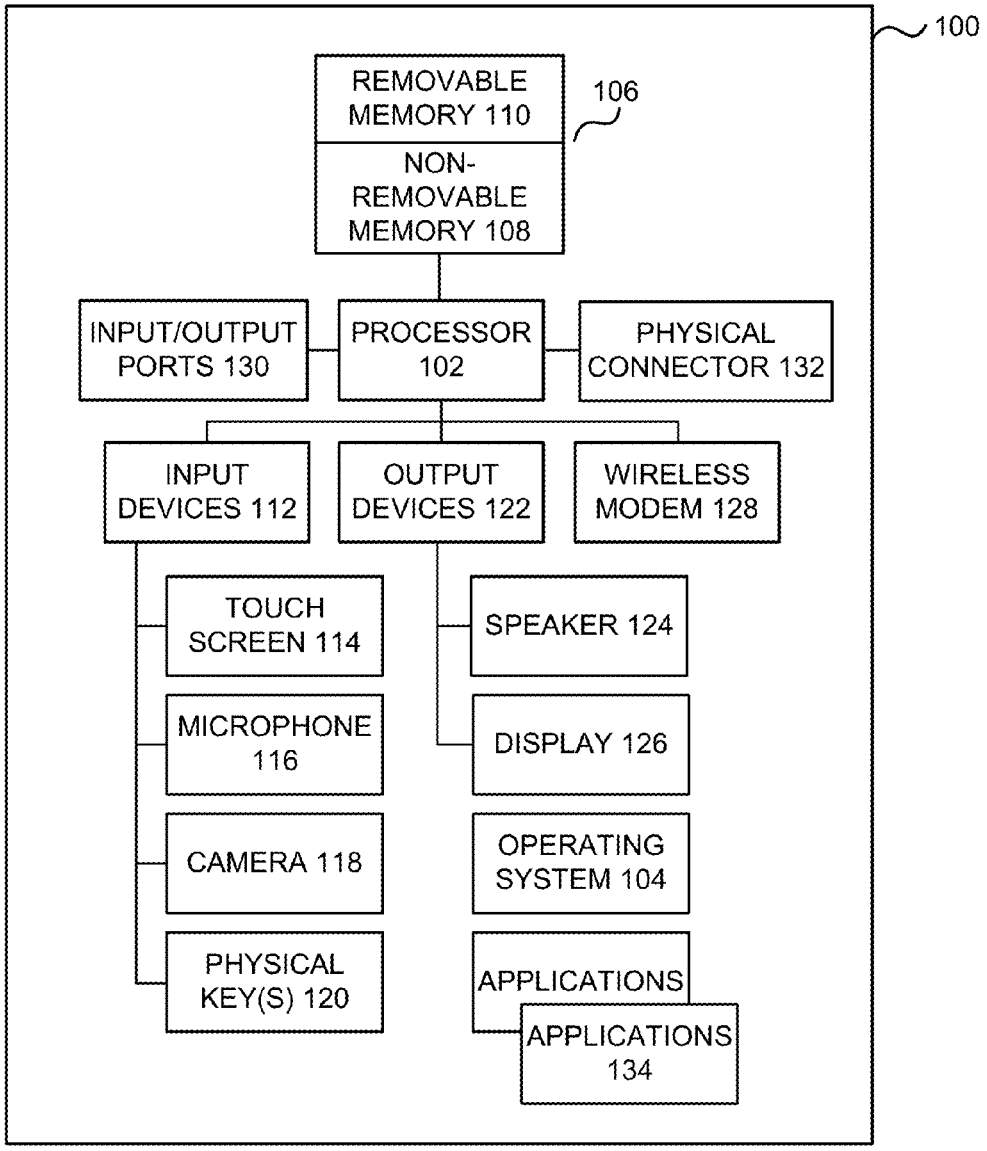
FIG. 1 is a system diagram depicting an apparatus including a variety of optional hardware and software components.

The detailed description provided below in connection with the appended drawings is intended as a description of the present examples and is not intended to represent the only forms in which the present example may be constructed or utilized. However, the same or equivalent functions and sequences may be accomplished by different examples. Furthermore, as used in this application and in the claims, the singular forms "a," "an," and "the" include the plural forms unless the context clearly dictates otherwise. Additionally, the term "includes" means "comprises." Further, the term "coupled" encompasses mechanical, electrical, magnetic, optical, as well as other practical ways of coupling or linking items together, and does not exclude the presence of intermediate elements between the coupled items.

A solution is provided where a display module of an apparatus is used as the speaker diaphragm and as a tactile feedback surface. The movement of the display module is actuated by a thin vibrating material plate or plates attached underneath the display module. The vibrating material plate or plates cause the display module to bend when the vibrating material plate or plates are actuated.

In at least some embodiments there is provided an apparatus comprising a frame and a speaker rigidly attached to the frame. The speaker comprises a display module and at least one vibrating deformable plate element attached to a bottom surface of the display module and configured to at least partially bend, when actuated, the display module to generate at least one of sound waves or tactile feedback.

When a conventional audio speaker and a haptic generator of a mobile electronic device are replaced with a vibrating material plate element attached to the display module, for example, a piezoelectric transducer, this adds only a minimal thickness penalty to the display module. Further, as there is no need for a separate speaker and a haptic generator, space savings within the mobile electronic device are achieved. Also, no separate speaker orifices are needed, usually taking up surface area on the front side of the mobile electronic device most notably occupied by the display screen. Without the orifices for the speaker the device can be made more water resistant and more surface area can be occupied by the display screen, thus also improving the mobile electronic device usability.

In the following, although the term "a rigid structure" or "a rigid planar structure" is used, the term "rigid structure" may refer to a substantially rigid structure that is still bendable by at least one vibrating deformable plate element, for example, a piezoelectric deformable plate element. Further, the term "planar" may refer a substantially planar or slightly curved surface used, for example, in mobile devices. Further, the term "plate element" refers to an element having a substantially uniform thickness and whose size (width and height) is substantial compared to its thickness. For example, the height of the plate element may be 5 cm and the width 3 cm, but the thickness of the plate element may be 0.1 mm only.

FIG. 1 is a system diagram depicting an electronic apparatus 100 including a speaker 124 and a variety of optional hardware and software components. The electronic apparatus 100 comprises a frame and a display module rigidly attached to the frame. Any components in the electronic apparatus 100 can communicate with any other component, although not all connections are shown, for ease of illustration. The apparatus 100 can be any of a variety of computing devices (for example, a cell phone, a smartphone, a handheld computer, a tablet computer, a laptop computer, a personal computer, a Personal Digital Assistant (PDA), a digital camera etc.).

The illustrated electronic apparatus 100 can include a controller or processor 102 (e.g., signal processor, microprocessor, ASIC, or other control and processing logic circuitry) for performing such tasks as signal coding, data processing, input/output processing, power control, and/or other functions. An operating system 104 can control the allocation and usage of the components and support for one or more application programs 134. The application programs can include common mobile computing applications (e.g., email applications, calendars, contact managers, web browsers, messaging applications), or any other computing application.

The illustrated electronic apparatus 100 can include a memory 106. The memory 106 can include non-removable memory 108 and/or removable memory 110. The non-removable memory 108 can include RAM, ROM, flash memory, a hard disk, or other well-known memory storage technologies. The removable memory 110 can include flash memory or a Subscriber Identity Module (SIM) card, which is well known in mobile communication systems, or other well-known memory storage technologies, such as "smart cards". The memory 106 can be used for storing data and/or code for running the operating system 104 and the applications 134. If the apparatus 100 is a mobile phone or smart phone, the memory 106 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The electronic apparatus 100 can support one or more input devices 112, such as a touchscreen 114, microphone 116, camera 118 and/or physical keys or a keyboard 120 and one or more output devices 122, such as a speaker 124 and a display 126. Some devices can serve more than one input/output function. For example, the touchscreen 114 and the display 126 can be combined in a single input/output device. The input devices 112 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 104 or applications 134 can comprise speech-recognition software as part of a voice user interface that allows a user to operate the electronic apparatus 100 via voice commands. Further, the electronic apparatus 100 can comprise input devices and software that allows for user interaction via a user's spatial gestures, such as detecting and interpreting gestures to provide input to a gaming application.

A wireless modem 128 can be coupled to an antenna (not shown) and can support two-way communications between the processor 102 and external devices, as is well understood in the art. The modem 128 is shown generically and can include a cellular modem for communicating with the mobile communication network and/or other radio-based modems (e.g., Bluetooth or Wi-Fi). The wireless modem 128 is typically configured for communication with one or more cellular networks, such as a GSM network for data and voice communications within a single cellular network, a WCDMA (Wideband Code Division Multiple Access) network, an LTE (Long Term Evolution) network, a 4G LTE network, between cellular networks, or between the mobile apparatus and a public switched telephone network (PSTN) etc.

The electronic apparatus 100 can further include at least one input/output port 130 and/or a physical connector 132, which can be a USB port, a USB-C port, IEEE 1394 (FireWire) port, and/or RS-232 port. The illustrated components are not required or all-inclusive, as any components can be deleted and other components can be added.

Figure 2:
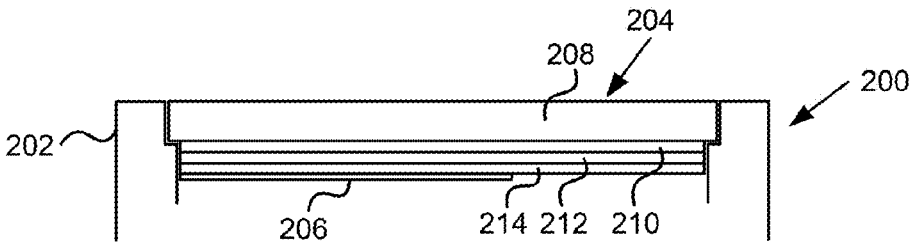
FIG. 2 illustrates an apparatus according to one embodiment.

FIG. 2 illustrates an apparatus 200 according to one embodiment. The apparatus 200 comprises a frame 202 to which a display module 204 is rigidly or firmly attached. The term "firmly attached" may allow some movement between the frame 202 and the display module 204. The display module 204 may be attached to the frame 202, for example, by gluing or using a two-sided adhesive. Any other method for firmly or rigidly attaching the display module 204 to the frame 202 may also be used. The display module 204 may be a substantially rigid planar structure. The substantially rigid planar structure 204 refers, for example, to any material or a layered structure that is, however, bendable in order to generate the needed sound pressure for audible sound. The surface structure 204 may also be a layered structure comprising multiple layers of different materials.

A vibrating deformable plate element 206 is attached to a bottom surface of the display module 204 as illustrated in FIG. 2. The vibrating deformable plate element 206 may be firmly attached to the display module 204 by any glue or adhesive that provides a hard non-flexible coupling of the vibrating deformable plate element 206 to the display module 204. The vibrating deformable plate element 206, when actuated (for example, driven with a voltage or current source), is configured to bend the display module 204 to generate at least one of sound waves or tactile feedback. Thus, the display module 204 may generate sound waves, tactile feedback or both. In one embodiment, the vibrating deformable plate element 206 is a piezoelectric or piezoceramic element. In one embodiment, thickness of the vibrating deformable plate element 206 may be the thickness of the 0.1 mm. Further, although FIG. 2 illustrates only a single vibrating deformable plate element 206, in other embodiments the number of vibrating deformable plate element and their sizes may vary.

The display module 204 may have a layered structure. The display module 204 may comprise a transparent window layer 208, an adhesive layer 210, and a display layer 212. Optionally, also a steel layer 214 may be used to rigidify the layer structure. The thickness of the transparent window layer 208 may be about 0.3 mm, the thickness of the adhesive layer 210 may be about 0.05 mm, the thickness of the display layer 212 may be about 0.1 mm, and the thickness of the steel layer 214 may be about 0.2 mm. It is evident that these measures are only examples and other thickness values may also be used.

In one embodiment of FIG. 2, an air gap, for example, 0.2 mm air gap is arranged between the vibrating deformable plate element 206 and the next apparatus 200 element to enable proper functioning of the vibrating deformable plate element 206.

The apparatus 200 may be a mobile electronic device, a smartphone. a computer, a television, a separate display device or an integrated display device, for example, in a car.

When a conventional audio speaker and a haptic generator of a mobile electronic device are replaced with a vibrating material plate element attached to the display module, for example, a piezoelectric transducer, this adds only a minimal thickness penalty to the display module. Further, as there is no need for a separate speaker and a haptic generator, space savings within the mobile electronic device are achieved. Further, as there is no separate speaker, no speaker orifices on the display screen are needed and surface area savings are achieved. This also leaves more surface area, for example, for the display screen and the apparatus can be made more water resistant.

Figure 3:
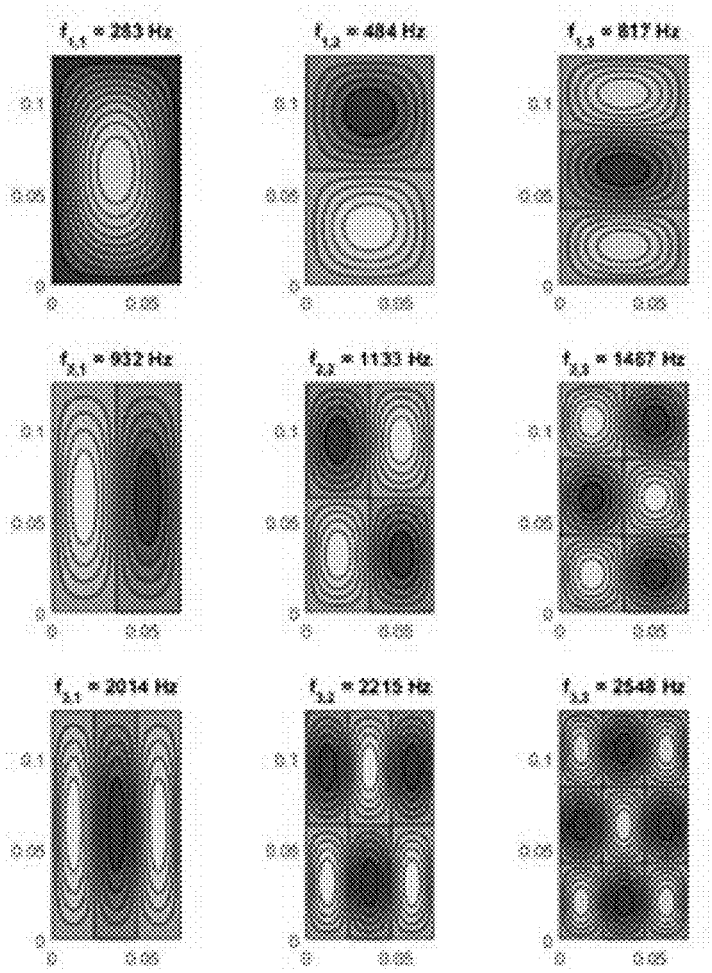
FIG. 3 illustrates vibrational eigenmodes of an exemplary display module governing the frequency response.

FIG. 3 illustrates vibrational eigenmodes of an exemplary display module governing the frequency response. FIG. 3 assumes that the display module is a rectangular place. For example, the eigenmodes of a rectangular plate of width a and height b, firmly attached from its edges, can be calculated with the following equation:

$$w_{m,n}(x, y) \approx \sin\left(\frac{m\pi x}{a}\right)\sin\left(\frac{n\pi y}{b}\right).$$

The corresponding eigenfrequencies be calculated with the following equation:

$$f_{m,n} \approx \left(\frac{m^2}{a^2} + \frac{n^2}{b^2}\right)\sqrt{\frac{D\pi^2}{4\rho h}},\ D = \frac{h^3 E}{12(1-\nu^2)},$$

where rho is the plate mass density, h is the plate thickness, E is the plate Young's modulus, and nu is the plate Poisson's constant. The geometry of the excitation source determines which modes get excited.

The utilization of most of the natural vibrational modes is beneficial to attain wide frequency response of large magnitude. An optimal vibrating deformable plate element arrangement excites most of the natural vibrational modes of the display module 204 while the vibrating deformable plate element arrangement still covers most of the area to generate enough sound pressure across the whole audio frequency range.

Figure 4:
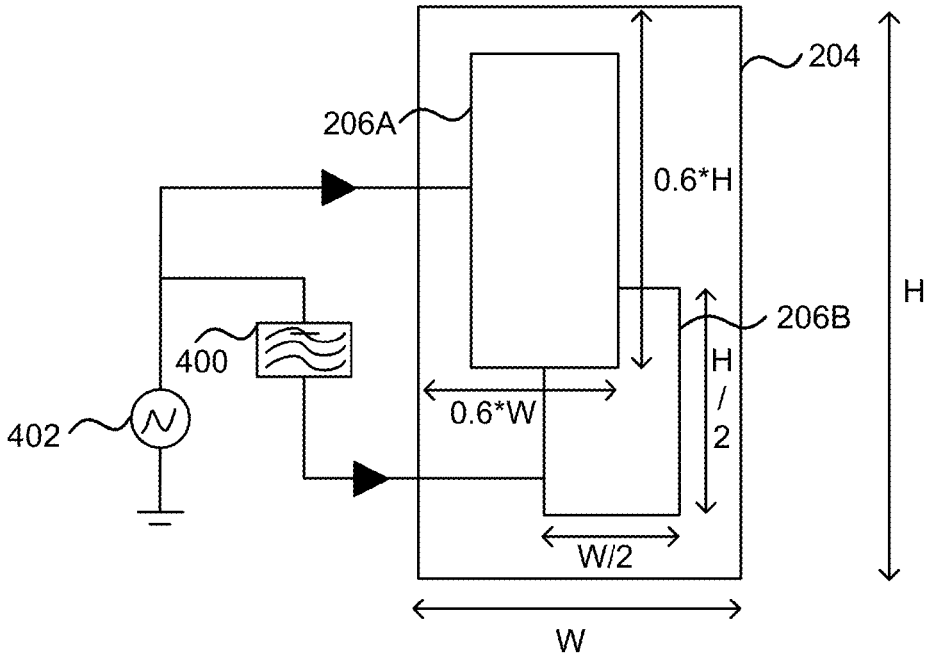
FIG. 4 illustrates an arrangement for operating vibrating deformable plate elements of a display module acting as a speaker according to one embodiment.

FIG. 4 illustrates an arrangement for operating vibrating deformable plate elements of a display module 204 acting as a speaker according to one embodiment.

The arrangement discloses two vibrating deformable plate elements, a rectangular vibrating deformable plate element 206A and an L-shaped vibrating deformable plate element 206B. The arrangement comprises also a low-pass filter 400 for L-shaped vibrating deformable plate element 206B and a signal generator 402.

To obtain strong haptic feedback and strong acoustic pressure on low frequencies, both vibrating deformable plate elements 206A, 206B are driven with low frequency signals. As signals are input to the L-shaped vibrating deformable plate element 206B via the low-pass filter 400, the L-shaped vibrating deformable plate element 206B can be driven only with low frequency signals. To obtain strong acoustic pressure on high frequencies, only the rectangular vibrating deformable plate element 206A is driven with the high frequency signals. The low-pass filter 400 prevents the L-shaped vibrating deformable plate element 206B to be active with high frequencies.

This arrangement ensures that on high frequencies above the fundamental mode of the display module 204, not so many harmonic modes get suppressed because the fed bending moment distribution would be incompatible with the mode shape near that frequency.

FIG. 4 also illustrates exemplary values for the width and height for the vibrating deformable plate elements 206A, 206B. The lower right corner of the vibrating deformable plate element 206A is at a position 0.6 times the height H of the display module 204. Similarly, the upper right corner of the vibrating deformable plate element 206A is at a position 0.6 times the width W of the display module 204. The height of the L-shaped vibrating deformable plate element 206B is H/2 and the width W/2.

Figure 5:
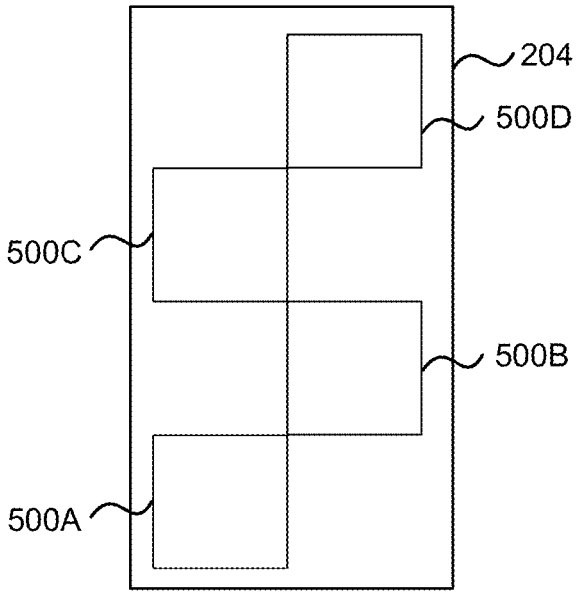
FIG. 5 illustrates locations of vibrating deformable plate elements of a speaker according to one embodiment.

FIG. 5 illustrates locations of vibrating deformable plate elements of a speaker according to one embodiment.

Vibrating deformable plate elements 500A, 500B, 500C, 500D are attached to a bottom surface of the display module 204 and configured to at least partially bend, when actuated, the display module 204 to generate at least one of sound waves or tactile feedback. Thus, the display module 204 may generate sound waves, tactile feedback or both. In this embodiment, the vibrating deformable plate elements 500A, 500B, 500C, 500D are arranged in a chessboard pattern and they are driven with the full frequency range and in-phase. The chessboard pattern suppresses fewer harmonic modes than a configuration where a vibrating deformable plate element is centered on the display module 204.

According to an aspect, there is provided an apparatus comprising a frame, and a speaker rigidly attached to the frame. The speaker comprises a display module and at least one vibrating deformable plate element attached to a bottom surface of the display module and configured to at least partially bend, when actuated, the display module to generate at least one of sound waves or tactile feedback.

In an embodiment, the display module is a substantially rigid layered structure comprising at least a transparent window layer, an adhesive layer, and a display layer.

In an embodiment, in any combination with any of the above embodiments, the display module further comprises a stiffening layer between the display layer and the at least one vibrating deformable plate element.

In an embodiment, in any combination with any of the above embodiments, the apparatus comprises two vibrating deformable plate elements attached to a bottom surface of the display module, wherein a first substantially rectangular vibrating deformable element extends at the bottom of the display surface over a center point of the bottom surface of the display module, and wherein the second vibrating deformable plate element is an L-shaped vibrating deformable plate element where the incomplete corner of the L-shaped vibrating magnetic deformable plate element is adapted to face the corner of first substantially rectangular vibrating deformable element extending over the center point of the bottom surface of the display module.

In an embodiment, in any combination with any of the above embodiments, the lower right corner of the first substantially rectangular vibrating deformable plate element is approximately at a position 0.6 times the height of the display module, the upper right corner of the first substantially rectangular vibrating deformable plate element is approximately at a position 0.6 times the width of the display module, the height of the second vibrating deformable plate element is half of the height of the display module and the width of the second vibrating deformable plate element is half of width of the display module.

In an embodiment, in any combination with any of the above embodiments, the apparatus comprises a low-pass filter for the second vibrating deformable plate element, and wherein both the first substantially rectangular vibrating deformable element and the second vibrating deformable plate element are configured to be driven on low frequencies.

In an embodiment, in any combination with any of the above embodiments, only the first substantially rectangular vibrating deformable element is configured to be driven on high frequencies.

In an embodiment, in any combination with any of the above embodiments, wherein the apparatus comprises multiple vibrating deformable plate elements attached to the bottom surface of the display module and being arranged in a chessboard pattern.

In an embodiment, in any combination with any of the above embodiments, the apparatus comprises multiple vibrating deformable plate elements attached to the bottom surface of the display module and being arranged in a matrix of vibrating deformable plate elements, and a phase shifter, wherein a first portion of the multiple vibrating deformable plate elements are configured to be driven in-phase, and wherein a second portion of the multiple vibrating deformable plate elements are configured to be driven via the phase shifter in an opposite phase.

In an embodiment, in any combination with any of the above embodiments, the at least one vibrating deformable plate element is a piezoelectric or a piezoceramic plate element.

In an embodiment, in any combination with any of the above embodiments, the apparatus comprises multiple vibrating deformable plate elements, wherein the vibrating deformable plate elements are sized and placed to utilize multiple vibrational modes of the display module.

In an embodiment, in any combination with any of the above embodiments, the display module is a substantially rigid and planar display module.

In an embodiment, in any combination with any of the above embodiments, the apparatus comprises one of the following: a mobile electronic apparatus, a smartphone, a tablet computer, a computer, a television, an external display apparatus or an integrated display apparatus.

According to another aspect, there is provided an apparatus comprising an audio signal generator, control circuitry, a frame and a speaker rigidly attached to the frame. The speaker comprises a display module and at least one vibrating deformable plate element attached to a bottom surface of the display module. The control circuitry is configured to cause the audio signal generator to generate an output to cause the at least one vibrating deformable plate element to at least partially bend the display module to generate at least one of sound waves or tactile feedback.

In an embodiment, the apparatus comprises two vibrating deformable plate elements attached to a bottom surface of the display module, wherein a first substantially rectangular vibrating deformable element extends at the bottom of the display surface over a center point of the bottom surface of the display module, and wherein the second vibrating deformable plate element is an L-shaped vibrating deformable plate element where the incomplete corner of the L-shaped vibrating magnetic deformable plate element is adapted to face the corner of first substantially rectangular vibrating deformable element extending over the center point of the bottom surface of the display module In an embodiment, in any combination with any of the above embodiments, the apparatus comprises a low-pass filter for the second vibrating deformable plate element, wherein both the first substantially rectangular vibrating deformable element and the second vibrating deformable plate element are configured to be driven on low frequencies.

In an embodiment, in any combination with any of the above embodiments, only the first substantially rectangular vibrating deformable element is configured to be driven on high frequencies.

In an embodiment, in any combination with any of the above embodiments, the apparatus comprises multiple vibrating deformable plate elements attached to the bottom surface of the display module and being arranged in a chessboard pattern.

In an embodiment, in any combination with any of the above embodiments, the apparatus comprises multiple vibrating deformable plate elements, wherein the vibrating deformable plate elements are sized and placed to utilize multiple vibrational modes of the display module.

In an embodiment, the control circuity comprises at least one processing unit and at least one memory, where the at least one memory stores program instructions that, when executed by the at least one processing unit, cause the audio signal generator to generate the output to cause the at least one vibrating deformable plate element to at least partially bend the display module to generate at least one of sound waves or tactile feedback.

According to another aspect, there is provided a mobile electronic apparatus is provided. The mobile electronic apparatus comprises an audio signal generator, control circuitry, a frame and a speaker rigidly attached to the frame. The speaker comprises a display module and at least one vibrating deformable plate element attached to a bottom surface of the display module, wherein the control circuitry is configured to cause the audio signal generator to generate an output to cause the at least one vibrating deformable plate element to at least partially bend the display module to generate at least one of sound waves or tactile feedback.

In an embodiment, the control circuity comprises at least one processing unit and at least one memory, where the at least one memory stores program instructions that, when executed by the at least one processing unit, cause the audio signal generator to generate the output to cause the at least one vibrating deformable plate element to at least partially bend the display module to generate at least one of sound waves or tactile feedback.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), Graphics Processing Units (GPUs).

The functions described herein performed by a controller or a processor may be performed by software in machine readable form on a tangible storage medium e.g. in the form of a computer program comprising computer program code means adapted to perform all the steps of any of the methods described herein when the program is run on a computer and where the computer program may be embodied on a computer readable medium. Examples of tangible storage media include disks, thumb drives, memory etc. and do not include propagated signals. The software can be suitable for execution on a parallel processor or a serial processor such that the method steps may be carried out in any suitable order, or simultaneously.

Although the subject matter may have been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages.

Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification. In particular, the individual features, elements, or parts described in the context of one example, may be connected in any combination to any other example also.

The invention claimed is:

1. An apparatus comprising:

a frame;

a speaker rigidly attached to the frame, where the speaker comprises a display module and at least two vibrating deformable plate elements attached to a bottom surface of the display module and configured to at least partially bend, when actuated, the display module to generate at least one of sound waves or tactile feedback, the at least two vibrating deformable plate elements comprising a substantially rectangular vibrating deformable plate element and an L-shaped vibrating deformable plate element, and an incomplete corner of the L-shaped vibrating deformable plate element adapted to face and abut a corner of the substantially rectangular vibrating deformable plate element.

2. An apparatus of claim 1, wherein the display module is a substantially rigid layered structure comprising at least a transparent window layer, an adhesive layer, and a display layer.

3. An apparatus of claim 2, wherein the display module further comprises a stiffening layer between the display layer and the at least two vibrating deformable plate elements.

4. An apparatus of claim 1, wherein the substantially rectangular vibrating deformable plate element extends at the bottom surface of the display module over a center point of the bottom surface of the display module, and the incomplete corner of the L-shaped vibrating deformable plate element is adapted to extend over the center point of the bottom surface of the display module.

5. An apparatus of claim 1, wherein a lower right corner of the substantially rectangular vibrating deformable plate element is approximately at a position 0.6 times a height of the display module, an upper right corner of the substantially rectangular vibrating deformable plate element is approximately at a position 0.6 times a width of the display module, a height of the L-shaped vibrating deformable plate element is half of the height of the display module and a width of the L-shaped vibrating deformable plate element is half of the width of the display module.

6. An apparatus of claim 1, further comprising:

a low-pass filter for the L-shaped vibrating deformable plate element; and wherein both the substantially rectangular vibrating deformable plate element and the L-shaped vibrating deformable plate element are configured to be driven on low frequencies.

7. An apparatus of claim 1, wherein only the substantially rectangular vibrating deformable plate element is configured to be driven on high frequencies.

8. An apparatus of claim 1, wherein the at least two vibrating deformable plate elements are piezoelectric or piezoceramic plate elements.

9. An apparatus of claim 1, wherein the at least two vibrating deformable plate elements are sized and placed to utilize multiple vibrational modes of the display module.

10. An apparatus of claim 1, wherein the display module is a substantially rigid and planar display module.

11. An apparatus of claim 1, wherein the apparatus comprises one of the following: a mobile electronic apparatus, a smartphone, a tablet computer, a computer, a television, an external display apparatus or an integrated display apparatus.

12. An apparatus comprising:

an audio signal generator;

control circuitry;

a frame;

a speaker rigidly attached to the frame, where the speaker comprises a display module and at least two vibrating deformable plate elements attached to a bottom surface of the display module;

wherein the at least two vibrating deformable plate elements comprise a substantially rectangular vibrating deformable plate element and an L-shaped vibrating deformable plate element, and an incomplete corner of the L-shaped vibrating deformable plate element is adapted to face and abut a corner of the substantially rectangular vibrating deformable plate element, and wherein the control circuitry is configured to cause the audio signal generator to generate an output to cause the at least two vibrating deformable plate elements to at least partially bend the display module to generate at least one of sound waves or tactile feedback.

13. An apparatus of claim 12, wherein the substantially rectangular vibrating deformable plate element extends at the bottom surface of the display module over a center point of the bottom surface of the display module, and where the incomplete corner of the L-shaped vibrating magnetic deformable plate element is adapted to extend over the center point of the bottom surface of the display module.

14. An apparatus of claim 12, further comprising:

a low-pass filter for the L-shaped vibrating deformable plate element; and wherein both the substantially rectangular vibrating deformable plate element and the L-shaped vibrating deformable plate element are configured to be driven on low frequencies.

15. An apparatus of claim 12, wherein only the substantially rectangular vibrating deformable plate element is configured to be driven on high frequencies.

16. An apparatus of claim 12, wherein the at least two vibrating deformable plate elements are sized and placed to utilize multiple vibrational modes of the display module.

17. A mobile electronic apparatus comprising:

an audio signal generator;

control circuitry;

a frame;

a speaker rigidly attached to the frame, where the speaker comprises a display module and at least two vibrating deformable plate elements attached to a bottom surface of the display module;

wherein the at least two vibrating deformable plate elements comprise a substantially rectangular vibrating deformable plate element and an L-shaped vibrating deformable plate element, and an incomplete corner of the L-shaped vibrating deformable plate element is adapted to face and abut a corner of the substantially rectangular vibrating deformable plate element, wherein the control circuitry is configured to cause the audio signal generator to generate an output to cause the at least two vibrating deformable plate elements to at least partially bend the display module to generate at least one of sound waves or tactile feedback.

18. An apparatus of claim 1, wherein only the L-shaped vibrating deformable plate element is configured to be driven on low frequencies.

19. An apparatus of claim 13, wherein only the L-shaped vibrating deformable plate element is configured to be driven on low frequencies.

20. A mobile electronic apparatus of claim 17, wherein only the L-shaped vibrating deformable plate element is configured to be driven on low frequencies.

* * * * *